United States Patent [19]

Kimura et al.

[11] Patent Number: 4,537,166

[45] Date of Patent: Aug. 27, 1985

[54] LUBRICATING ARRANGEMENT IN VALVE MECHANISM OF AN OVERHEAD CAMSHAFT ENGINE

[75] Inventors: Kenji Kimura, Sayama; Masayasu Nishikawa, Tokyo, both of Japan

[73] Assignee: Honda Giken Kogyo Kabushiki Kaisha, Tokyo, Japan

[21] Appl. No.: 536,253

[22] Filed: Sep. 27, 1983

[30] Foreign Application Priority Data

Sep. 27, 1982 [JP] Japan ..... 57-168210

[51] Int. Cl.[3] ..... F01L 1/46

[52] U.S. Cl. ..... 123/90.36; 123/90.34; 123/90.27

[58] Field of Search ..... 123/70.33, 90.34, 90.36, 123/90.27

[56] References Cited

U.S. PATENT DOCUMENTS

| | | | |
|---|---|---|---|
| 2,641,235 | 6/1953 | Slonneger | 123/90.36 X |
| 3,531,234 | 9/1970 | Ravenel | 123/90.34 X |
| 3,628,513 | 12/1971 | Grousseau | 123/90.34 |
| 4,258,673 | 3/1981 | Stooly, Jr. et al. | 123/90.34 |
| 4,441,465 | 4/1984 | Nakamura | 123/90.33 X |
| 4,448,166 | 5/1984 | Amemori et al. | 123/90.39 X |

*Primary Examiner*—William R. Cline

*Assistant Examiner*—Peggy A. Neils

*Attorney, Agent, or Firm*—Lyon & Lyon

[57] ABSTRACT

In the valve mechanism of an internal combustion engine of the overhead camshaft type, a camshaft holder mounted on the cylinder head and supporting rocker shafts thereon has two bearing recesses having a generally semicylindrical shape, formed in a side surface remote from the cylinder head for supporting a pair of rocker shafts received therein, and a lubricating oil passage formed therein and communicating a lubricating oil passage formed in the cylinder head with the hollow interior of one of the rocker shafts. The camshaft holder is further formed therein with two communication passages communicating a peripheral groove formed in a bearing surface opening in a side surface facing the cylinder head for supporting the camshaft, respectively, with two annular gaps defined between two bolt-fitting holes and two bolts extending therethrough to fix the rocker shafts and the camshaft holder to the cylinder head. Lubricating oil supplied to the hollow interior of the above one rocker shaft through the lubricating oil passages is delivered to the hollow interior of the other rocker shaft through one of the annular gaps, one of the communication passages, the peripheral groove, the other communication passage and the other annular gap in the mentioned order.

11 Claims, 7 Drawing Figures

LUBRICATING ARRANGEMENT IN VALVE MECHANISM OF AN OVERHEAD CAMSHAFT ENGINE

BACKGROUND OF THE INVENTION

This invention relates to lubrication of the valve mechanism of an internal combustion engine, and more particularly to a lubricating arrangement in the valve mechanism of an overhead camshaft engine.

The valve mechanism or valve motion of an internal combustion engine of the overhead camshaft (OHC) type is generally comprised of a plurality of camshaft holders mounted on the cylinder head, a camshaft rotatably supported by the camshaft holders, a pair of rocker shafts usually having a hollow tubular structure, secured to the camshaft holders, and at least one pair of rocker arms mounted on the rocker shafts for rocking motions thereabout and operable in response to the rotation of the camshaft for causing the intake valves and exhaust valves to be closed and opened alternately.

In such a valve mechanism, the rocker shafts are fitted in or through bearing holes in the camshaft holders, and are rigidly fastened to the cylinder head together with the camshaft holders by means of bolts extending through the rocker shafts and the camshaft holders.

Lubricating oil for lubricating the sliding parts of the valve mechanism is supplied from an oil pan provided in the engine, fed through oil passages formed in the cylinder block, the cylinder head and some of the camshaft holders, and guided into the hollow interiors of the rocker shafts. Then, the oil is delivered from the hollow interiors of the rocker shafts through small bores formed in the rocker shafts to lubricate the rocker arms and the camming surfaces of the camshaft, and also led to the intake valves and exhaust valves of the engine to lubricate same.

However, in order to ensure smooth fitting of the rocker shafts into or through the bearing holes of the camshaft holders, the clearances between the rocker shafts and the respective bearing holes have to be set at somewhat large values. Further, the rocker shafts have their peripheral surfaces held against the inner surfaces of the bearing holes of the camshaft holders by means of the fastening bolts. It is therefore difficult to machine and assemble the rocker shafts and the camshaft holders so as to adjust and hold the above clearances to and at desired fine values throughout the whole peripheries of the rocker shafts enough to keep sufficient oiltightness between the rocker shafts and the camshaft holders. As a consequence, there can easily occur leakage of oil through the gaps between the rocker shafts and the bearing holes, impeding positive feeding of a required amount of lubricating oil to various sliding parts of the valve mechanism such as the rocker arms.

To supply an increased amount of lubricating oil to the valve mechanism so as to make up for the leaked amount, an oil pump having a large capacity or discharge quantity is required, inviting an increased manufacturing cost. On the other hand, to reduce the leakage amount of oil per se, very tight tolerances are required in machining the rocker arms and the bearing portions of the camshaft holders and assembling these parts, also resulting in an increase in the manufacturing cost.

Besides the above disadvantages, the conventional lubricating arrangement has another disadvantage that the intake side rocker arms and the exhaust side rocker arms are supplied with lubricating oil through different lubricating systems, making the lubricating arrangement complicate in structure.

SUMMARY OF THE INVENTION

It is an object of the invention to provide a lubricating arrangement for the valve mechanism of an internal combustion engine of the overhead camshaft type, which is substantially free from leakage of lubricating oil through the joints between the rocker shafts and the camshaft holders, thereby enabling positive supply of a required amount of lubricating oil to the sliding parts of the valve mechanism.

It is a further object of the invention to provide a camshaft holder for use in the valve mechanism of this kind, which is simple in structure and easy to fabricate and assemble with related parts.

According to the invention, a camshaft holder has first and second bearing recesses having a generally semicylindrical shape corresponding to the cylindrical outer configuration of the rocker shafts, formed in a side surface thereof remote from the cylinder head and arranged in spaced relation to each other for supportingly receiving two rocker shafts, a first lubricating oil passage formed therein and communicating at one end with a lubricating oil passage formed in the cylinder head and opening at the other end in one of the first and second bearing recesses. A second lubricating oil passage is formed in one of the rocker shafts received in the above one bearing recess and communicates the first lubricating oil passage with the hollow interior of the above one rocker shaft. First and second bolts extend through respective ones of the rocker shafts and respective ones of first and second bolt-fitting holes formed in the camshaft holder and are threadedly fitted in the cylinder head to thereby rigidly fasten both the rocker shafts and the camshaft holder to the cylinder head.

The rocker shafts are each formed therein with a through hole communicating the hollow interior of its own with a corresponding one of the first and second bolt-fitting holes and through which a corresponding one of the first and second bolts extends. Each of the first and second bolt-fitting holes and a corresponding one of the above through holes cooperate with the corresponding bolt to define a first or second annular gap therebetween. The camshaft holder further includes a recess formed in a side surface thereof facing the cylinder head and cooperating with a recess formed in an opposed side surface of the cylinder head to define a generally cylindrical bearing space in which the camshaft is supportedly received, a circumferentially extending peripheral groove formed in the inner peripheral surface of the above recess of the camshaft holder, and first and second communication passages communicating the above peripheral groove, respectively, with the above first and second annular gaps.

The above and other objects, features and advantages of the invention will be more apparent from the ensuing detailed description taken in conjunction with the accompanying drawings.

DETAILED DESCRIPTION

Figure 1:
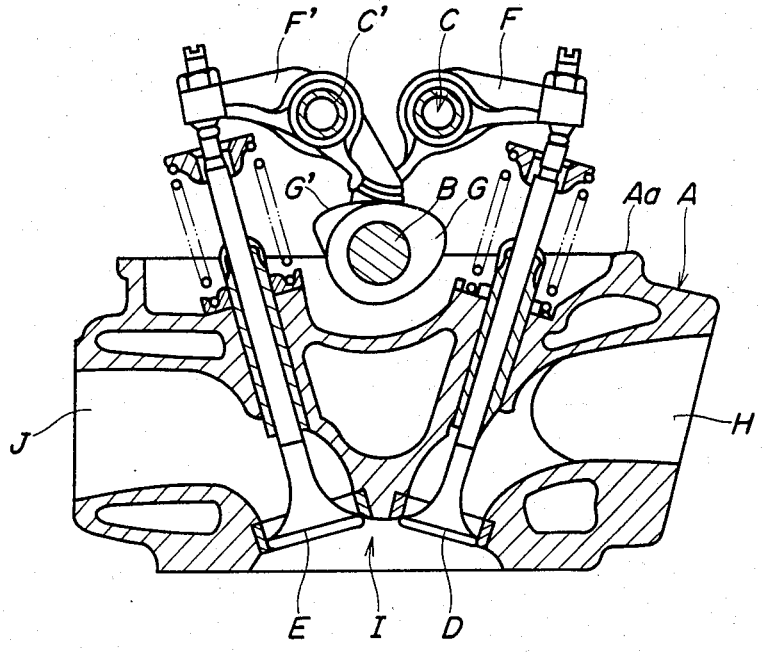
FIG. 1 PRIOR ART
FIG. 1 is a front view of a conventionally typical example of the valve mechanism of an overhead camshaft engine.
Figure 2:
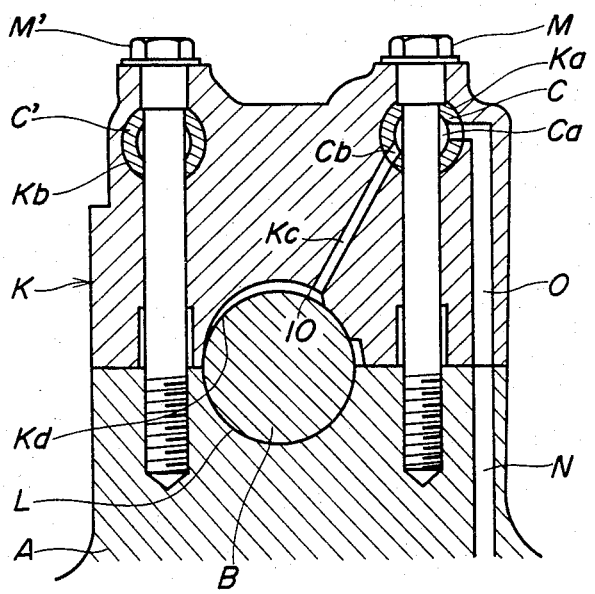
FIG. 2 is a sectional view of a conventional example of the arrangement of rocker shafts in a camshaft holder.

Referring to FIGS. 1 and 2, there is illustrated a conventionally typical example of the valve mechanism of an internal combustion engine of the overhead camshaft (OHC) type. In FIG. 1, a camshaft B is disposed at a substantially central portion of a side surface Aa of a horizontally disposed cylinder head A remote from a cylinder, not shown, of the engine. At a level higher than the camshaft B, two rocker shafts C and C' are arranged parallel with each other, with the camshaft B located intermediately thereof. Rockably supported, respectively, on these rocker shafts C, C' are intake side rocker arms F and exhaust side rocker arms F' (only one of each them is shown) drivingly coupled at one ends, respectively, to intake valves D and exhaust valves E (only one of each them is shown), and engaged at the other ends with respective cams G, G' formed on the camshaft B, whereby as the camshaft B rotates in unison with rotation of the engine crankshaft, the rocker arms are actuated by the cams G, G' to cause the respective intake valves D and exhaust valves E to be closed and opened alternately, so that fuel is sucked into the combustion chamber I of each cylinder through a corresponding intake port H, and exhaust gases are emitted from the combustion chamber I into a corresponding exhaust port J, alternately.

As shown in FIG. 2, the camshaft B is rotatably supportedly fitted in a bearing space L defined by recesses formed in opposed side surfaces of the cylinder head A and a camshaft holder K. The rocker shafts C, C' have ends supportedly fitted in respective bearing holes Ka and Kb formed in the camshaft holder K, and firmly held in place within the bearing holes Ka, Kb by means of bolts M and M' extending through the respective rocker shafts C, C' and the camshaft holder K and threadedly fitted in the opposed side surface of the cylinder head A.

Lubricating oil in an oil pan, not shown, is sucked by an oil pump, not shown, and fed through a lubricating oil passage formed in the cylinder block, not shown, and then through lubricating oil passages N and 0 formed, respectively, in the cylinder head A and the camshaft holder K, into the hollow interior Ca of one C of the rocker shafts. Then, part of the lubricating oil in the hollow interior Ca is discharged through small holes, not shown, formed in the peripheral wall of the rocker shaft C to be supplied to the corresponding rocker arms F to lubricate same, while the remaining oil is discharged through a small hole Cb in the peripheral wall of the rocker shaft C and fed through a communication passage Kc to a peripheral groove Kd formed in the inner peripheral wall of the bearing opening L to lubricate the camshaft B. The lubricating oil fed to the rocker arms, the camshaft, etc. flows into an oil bath cavity, not shown, in the cylinder head A to lubricate the cam G, the intake valve D, etc. and thereafter it travels through a chute, not shown, in the cylinder head A and a return passage in the cylinder block to be returned to the oil pan.

A lubricating passage arrangement similar to the one shown in FIG. 2 is provided for the other rocker shaft C', which is formed in another camshaft holder supporting the other end of the camshaft B.

According to the above conventional lubricating arrangement, the clearance between the peripheral surface of the rocker shaft C (C') and the bearing hole Ka of the camshaft holder K is difficult to keep at a fine and uniform value over the whole periphery of the rocker shaft enough to ensure sufficient oiltightness therebetween for the aforementioned reasons, thereby providing the problem of leakage of lubricating oil through the gap between the rocker shaft and the bearing hole and the aforementioned problems derived therefrom.

An embodiment of the present invention will now be described in detail with reference to FIGS. 3 through 6. In these figures, a side surface 20*a* of a camshaft holder 20 remote from the cylinder head 14 is formed therein with two bearing recesses 21 and 22 in the form of generally semicylindrical grooves for supporting rocker shafts having cylindrical outer configurations, received therein. The bearing grooves 21, 22 transversely extend through the camshaft holder at opposite end portions thereof. Bolt-fitting holes 23 and 24 are provided, in the central bottom portions of the bearing grooves 21, 22, which extend through the camshaft holder 20 to the bottom surface 20*b* thereof. These bolt-fitting holes 23, 24 each have a stepped inner periheral surface, with its smaller diameter being larger than the outer diameter of bolts 32 and 33 (in FIG. 6) fitted therethrough as hereinafter referred to. A lubricating oil passage 25 extends through an end portion of the camshaft holder 20 and substantially parallel with the associated bolt-fitting hole 24. The passage 25 has one end 25*a* opening in the bottom surface 20*b* of the camshaft holder 20 and the other end 25*b* opening in the bottom surface of the associated bearing groove 22 at a predetermined location. The above one end 25*a* of the passage 25 is aligned with one end 15*a* of a lubricating oil passage 15 formed in the cylinder head 14, as shown in FIG. 6.

Figure 4:
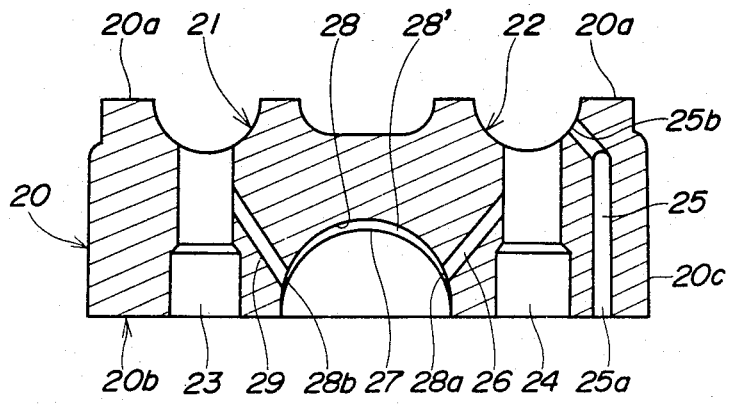
FIG. 4 is a longitudinal sectional view of the camshaft holder of FIG. 3.
Figure 5:
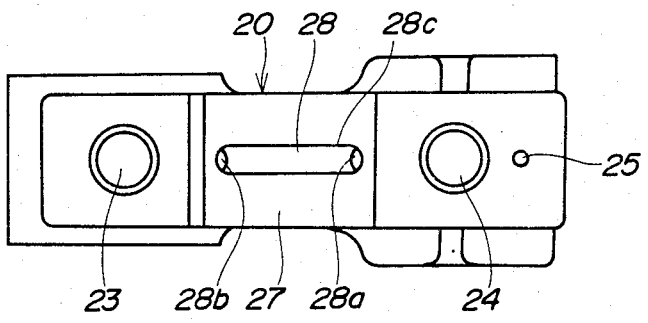
FIG. 5 is a schematic plan view showing the bottom surface of the camshaft holder of FIG. 3.

The bottom surface 20*b* of the camshaft holder 20 is formed therein with a generally semicylindrical camshaft bearing recess 27 at its substantially central location, which transversely extends through the camshaft holder 20. As best shown in FIGS. 4 and 5, a peripheral groove 28 having an arcuate longitudinal section is formed in the inner peripheral surface of the bearing recess 27 and circumferentially extends at a transversely central location thereof, which cooperates with the outer peripheral surface of the camshaft 2 fitted in the bearing recess 27 to define a lubricating oil chamber 28'. The camshaft holder 20 is further formed therein with communication passages 26 and 29 obliquely extending from the bearing recess 27, i.e. the peripheral groove 28, respectively, to the bolt-fitting holes 24, 23 respectively. The communication passage 26 has one end into one end 28*a* of the peripheral groove 28 and the other end opening in the bolt-fitting hole 24 to thereby communicate the hole 24 with the groove 28. The other communication passage 29 has one end opening in the other end 28*b* of the peripheral groove 28 and the other end opening in the other bolt-fitting hole 23 to thereby communicate the hole 23 with the groove 28. In this way, the hole 23, the groove 28 and the hole 24 are communicated with each other by way of the communication passages 26, 29.

Figure 6:
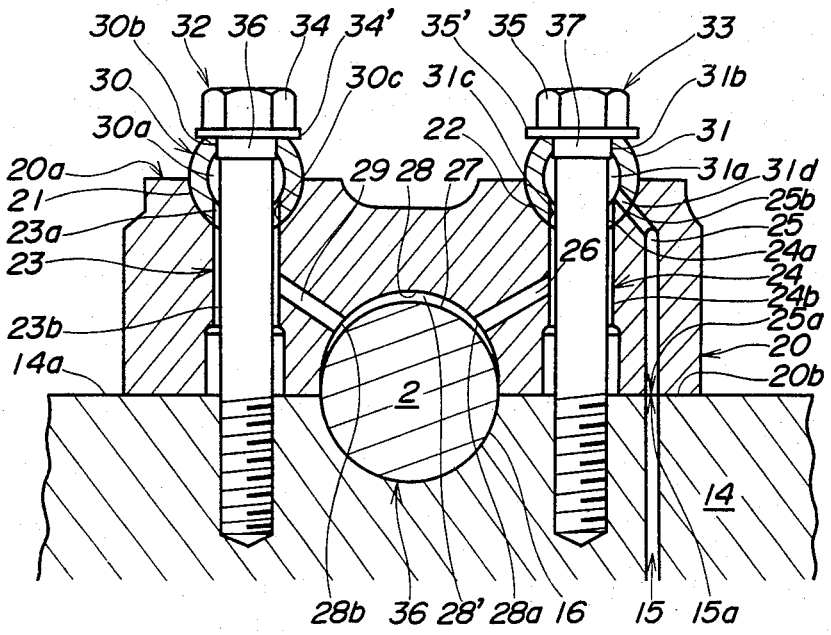
FIG. 6 is a longitudinal sectional view of the camshaft holder of FIG. 3, in a state mounted on the cylinder head together with the rocker shafts.
Figure 7:
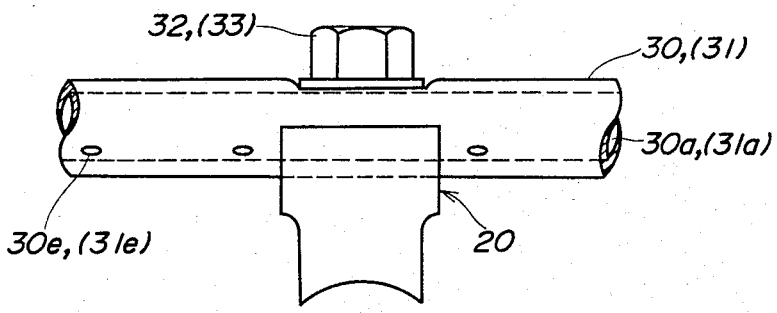
FIG. 7 is a side view of the connection between the camshaft holder and one of the rocker shafts in FIG. 6.

An intake side rocker shaft 30 and an exhaust side rocker shaft 31 are each formed of a hollow tube having a hollow interior 30*a* or 31*a* as best shown in FIG. 6, and are snugly fitted in the respective bearing grooves 21, 22 with their lower half peripheral surface portions in contact with the peripheral surfaces of the bearing grooves. The rocker shafts 30, 31 have diametrically opposite through holes 30*b*, 30*c*, and 31*b*, 31*c*, respectively, at locations aligned with the respective bolt-fitting holes 23, 24. These holes 30*b*, 30*c*, 31*b*, and 31*c* have substantially the same inner diameter with that of the bolt-fitting holes 23, 24. As shown in Fig. 7, each of the rocker shafts 30, 31 has a plurality of axially spaced small holes 30*e* or 31*e* at a lower peripheral surface portion thereof. Further, the rocker shaft 31 has its peripheral wall formed with a communication hole 31*d* at a location aligned with the end 25*b* of the lubrication oil passage 25. Thus, the hollow interior 31*a* of the rocker shaft 31 communicates with the lubrication oil passage 25 through the hole 31*d*.

As shown in FIG. 6, the bolts 32, 33 extend, respectively, through the through holes 30*b*, 30*c* of the rocker shaft 30 and the bolt-fitting hole 23, and through the through holes 31*b*, 31*c* of the other rocker shaft 31 and the bolt-fitting hole 24 to thereby rigidly fasten both the rocker shafts 30, 31 and the camshaft holder 20 to the cylinder head 14. Each of the bolts 32, 33 has its head 34, 35 formed integrally with an annular flange 34', 35' serving as a seating portion, and has an enlarged portion 36, 37 immediately adjacent the annular flange, which is tightly fitted through the through hole 30*b*, 31*b* of the rocker shaft 30, 31 so that when the rocker shaft is fastened by the bolt 32, 33, the hole 30*b*, 31*b* of the rocker shaft 30, 31 has its inner peripheral surface urgedly held against the peripheral surface of the enlarged portion 36, 37 and a peripheral edge urgedly held against the opposed surface of the seating portion 34', 35' to thereby prevent leakage of oil from the hollow interior 30*a*, 31*a* through the hole 30*b*, 31*b*.

By thus snugly fitting the cylindrical rocker shafts 30, 31 in the semicylindrical bearing recesses 21, 22 and fastening the rocker shafts against the bearing surfaces of the same bearing recesses, the difficulty of adjusting and holding the clearances between the bearing recesses and the rocker shafts to and at satisfactorily uniform and fine values over the whole peripheries of the rocker shafts as in the conventional arrangement can be eliminated. That is, according to the arrangement of the invention, by virtue of the substantially reduced effective bearing surface area as well as the single direction in which the rocker shafts are held against the bearing grooves, the clearances can be adjusted to and held at fine values assuring sufficient oiltightness at the bearing portions, with ease.

The side surface 14*a* of the cylinder head 14 is formed therein with a generally semicylindrical camshaft bearing recess 16 transversely extending through the head 14 and aligned with the generally semicylindrical camshaft bearing recess 27 in the camshaft holder 20, to cooperate with the latter to define a generally cylindrical camshaft bearing space 36 through which the camshaft 2 is rotatably supportedly fitted.

The above constructed lubricating oil passage arrangement is usually provided in at least one of a plurality of camshaft holders 20 which are arranged over the cylinder head 14, for instance in a central one of the camshaft holders. However, if required, it may be provided in two or more of the camshaft holders.

With the above arrangement, lubricating oil which has been delivered to the camshaft holder 20 through the lubricating oil passage 15 in the cylinder head 14 is guided through the lubricating oil passage 25 formed in the camshaft holder 20 and the communication passage 31*d* in the rocker shaft 31 into the hollow interior 31*a* of the same rocker shaft 31. Part of the oil in the hollow interior 31*a* flows through the small holes 31*e* to be fed to the rocker arms F, the cam G, the intake valve D, etc. to lubricate the sliding surfaces of these parts, and then travels through a chute, not shown, in the cylinder head 14 and a return passage, not shown, in the cylinder block, and is returned to the oil pan of the engine. On the other hand, the remainder of oil in the hollow interior 31*a* of the rocker shaft 31 is guided through an annular gap 24*a* between the bolt 33 and the through hole 31*c* of the rocker shaft 31 into another annular gap 24*b* between the bolt 33 and the bolt-fitting hole 24 of the camshaft holder 20, and then is guided through the communication passage 26 into the peripheral groove 28 to lubricate the sliding surfaces of the camshaft 2 and the camshaft bearing space 36. Thereafter, the lubricating oil in the peripheral groove 28 is further guided through the other communication passage 29, an annular gap 23*b* between the bolt 32 and the bolt-fitting hole 23 of the camshaft holder 20, and an annular gap 23*a* between the bolt 32 and the through hole 30*c* of the rocker shaft 30 into the hollow interior 30*a* of the rocker shaft 30. Then, it is discharged through the small holes 30*e* formed in the rocker shaft 30 to be fed to the rocker arms F', the cam G', the exhaust valves E, etc. to lubricate the sliding surfaces of these parts, and thereafter returned to the oil pan in the same way as previously stated.

What is claimed is:

1. In a valve mechanism for an internal combustion engine of the overhead camshaft type, including a cylinder head having a lubricating oil passage formed therein, at least one pair of intake valve and exhaust valve, a pair of rocker shafts, each having a substantially cylindrical outer configuration and a hollow interior defined therein, each of said rocker shafts having a peripheral wall thereof formed with a pair of diametrically opposite through holes, at least one pair of rocker arms supported on said rocker shafts for rocking motions thereabout and drivingly coupled, respectively, to said intake valve and said exhaust valve, a camshaft drivingly coupled to said rocker arms for causing rocking motions thereof, whereby rocking motions of said rocker arms in response to rotation of said camshaft cause said intake valve and exhaust valve to be closed and opened alternately, a camshaft holder rotatably supporting said camshaft and supporting said rocker shafts, said camshaft holder having first and second bolt-fitting holes formed therein, and first and second bolts extending through respective ones of said through holes of said rocker shafts and said first and second bolt-fitting holes of said camshaft holder and threadedly fitted in said cylinder head to fasten said rocker shafts and said camshaft holder thereto, the improvement wherein said camshaft holder has first and second bearing recesses, each having a generally semicylindrical shape corresponding to said outer configuration of said rocker shafts, said first and second bearing recesses opening in a side surface of said camshaft holder remote from said cylinder head and arranged in spaced relation to each other, said rocker shafts having part of said peripheral walls thereof supportedly received in respective ones of said first and second bearing recesses, a first lubricating oil passage formed in said camshaft holder and having one end communicating with said lubricating oil passage formed in said cylinder head and another end opening in one of said first and second bearing recesses, one of said rocker shafts being received in said one bearing recess and having a second lubricating oil passage formed therein and communicating said first lubricating oil passage with said hollow interior of said one rocker shaft, said first and second bolt-fitting holes extending from respective ones of said first and second bearing recesses to another side surface of said camshaft holder facing said cylinder head.

2. A valve mechanism as claimed in claim 1, wherein one of said through holes of said one rocker shaft communicates said hollow interior of said one rocker shaft with a corresponding one of said first and second bolt-fitting holes, one of said first and second bolts extending through said one through hole, said corresponding one bolt-fitting hole and said one through hole each having an inner diameter larger than the outer diameter of said one bolt to define an annular gap therebetween, said camshaft holder having a recess formed in said another side surface thereof and having an inner peripheral surface, said recess cooperating with a recess formed in a surface of said cylinder head facing said camshaft holder to define a generally cylindrical bearing space in which said camshaft is supportedly fitted, a circumferentially extending peripheral groove formed in said inner peripheral surface of said recess of said camshaft holder, and a communication passage formed in said camshaft holder and communicating said peripheral groove with said annular gap.

3. A valve mechanism as claimed in claim 2, wherein one of said through holes of the other one of said rocker shafts communicates said hollow interior of said other one rocker shaft with a corresponding one of said first and second bolt-fitting holes, the other one of said first and second bolts extending through said last-mentioned one through hole said last-mentioned corresponding one bolt-fitting hole and said last-mentioned one through hole each having an inner diameter larger than the outer diameter of said other one bolt to define a second annular gap therebetween, said camshaft holder having a second communication passage formed therein and communicating said peripheral groove with said second annular gap.

4. A valve mechanism as claimed in claim 3, wherein said first and second bolts each have an annular flange serving as a seat formed at one end thereof, and an enlarged portion immediately adjacent said annular flange, said enlarged portion being tightly fitted through one of said through holes of a corresponding one of said rocker shafts, said one through hole of said corresponding one rocker shaft having a peripheral edge urgedly held against said annular flange.

5. A valve mechanism as claimed in claim 3, wherein said recess of said camshaft holder forming said generally cylindrical bearing space is located intermediately of said first and second bolt-fitting holes.

6. In a valve mechanism for an internal combustion engine of the overhead camshaft type, including a cylinder head having a lubricating oil passage formed therein, at least one pair of intake valve and exhaust valve, a pair of rocker shafts, each having a substantially cylindrical outer configuration and a hollow interior defined therein, each of said rocker shafts having a peripheral wall thereof formed with a pair of diametrically opposite through holes, at least one pair of rocker arms supported on said rocker shafts for rocking motions thereabout and drivingly coupled, respectively, to said intake valve and said exhaust valve, a camshaft drivingly coupled to said rockerarms for causing rocking motions thereof, whereby rocking motions of said rocker arms in response to rotation of said camshaft cause said intake valve and exhaust valve to be closed and opened alternately, a camshaft holder rotatably supporting said camshaft and supporting said rocker shafts, said camshaft holder having first and second bolt-fitting holes formed therein, and first and second bolts extending through respective ones of said through holes of said rocker shafts and said first and second bolt-fitting holes of said camshaft holder and threadedly fitted in said cylinder head to fasten said rocker shafts and said camshaft holder thereto, the improvement wherein said camshaft holder has first and second bearing recesses, each having a generally semicylindrical shape corresponding to said outer configuration of said rocker shafts, said first and second bearing recesses opening in a side surface of said camshaft holder remote from said cylinder head and arranged in spaced relation to each other, said rocker shafts having part of said peripheral walls thereof supportedly received in respective ones of said first and second bearing recesses, a first lubricating oil passage formed in said camshaft holder and having one end communicating with said lubricating oil passage formed in said cylinder head and another end opening in one of said first and second bearing recesses, one of said rocker shafts being received in said one bearing recess and having a second lubricating oil passage formed therein and communicating said first lubricating oil passage with said hollow interior of said one rocker shaft, said first and second bolt-fitting holes extending from respective ones of said first and second bearing recesses to another side surface of said camshaft holder facing said cylinder head, one of said through holes of each said rocker shafts communicating said hollow interior of said each rocker shaft with a corresponding one of said first and second bolt-fitting holes, a corresponding one of said first and second bolts extending through said one through hole, said first and second bolt-fitting holes and said one through holes of said rocker shafts each having an inner diameter larger than the outer diameter of said corresponding one bolt to define first and second annular gaps, respectively, between said first and second bolts and corresponding ones of said bolt-fitting holes and corresponding ones of said one through holes, said camshaft holder further having a recess formed in said another side surface thereof and having an inner peripheral surface, said recess cooperating with a recess formed in a surface of said cylinder head facing said camshaft holder to define a generally cylindrical bearing space in which said camshaft is supportedly fitted, a circumferentially extending peripheral groove formed in said inner peripheral surface of said recess of said camshaft holder, and first and second communication passages formed in said camshaft holder and communicating said peripheral groove with respective ones of said first and second annular gaps.

7. In the valve mechanism of an internal combustion engine of the type having an overhead camshaft and at least one hollow rocker arm shaft mounted on the cylinder head in a camshaft holder with a lubricating oil supply port in the cylinder head, the improvement comprising, a substantially semicircular recess formed in the upper surface of the camshaft holder, the rocker shaft having a substantially semicircular exterior surface fitting in said recess, aligned holes through said rocker shaft and camshaft holder, a bolt passing through said holes with means engaging the exterior of the rocker shaft for securing said rocker shaft and camshaft holder to the cylinder head, and plural passageways provided in the camshaft holder and rocker shaft for conducting lubricating oil from the supply port in the cylinder head to the interior of the rocker shaft and to the camshaft.

8. The valve mechanism of claim 7 wherein one of said plural passageways extends through the camshaft holder from the supply port in the cylinder head to said recess and a hole is provided in said rocker shaft in alignment therewith for conducting the oil to the interior of the rocker shaft.

9. The valve mechanism of claim 7 wherein one of said plural passageways is comprised of an annular gap provided between the exterior of said bolt and said aligned holes through the camshaft holder and the portion of said rocker shaft fitting in said recess.

10. The valve mechanism of claim 8 wherein said plural passageways are comprised of a first hole in said camshaft holder extending from the supply port in the cylinder head to a portion of the recess spaced from the said aligned holes, a second hole in said rocker shaft superimposed on said first hole for conducting oil to the interior of said rocker shaft, a third hole in said camshaft holder extending from the bolt-receiving hole therein to the camshaft, and said aligned holes for the bolt in the camshaft holder and the portion of the rocker shaft fitting in said recess being larger than said bolt for forming an annular gap as a said passageway for conducting the oil from the interior of the rocker shaft to said third hole and then to the camshaft.

11. The valve mechanism of claim 10 wherein there are two rocker shafts with said first hole communicating with only the first rocker shaft and a fourth hole is provided in said camshaft holder communicating the camshaft with the second rocker shaft.

* * * * *

UNITED STATES PATENT AND TRADEMARK OFFICE

CERTIFICATE OF CORRECTION

PATENT NO. : 4,537,166
DATED : August 27, 1985
INVENTOR(S) : Kenji Kimura et al.

Figure 3:
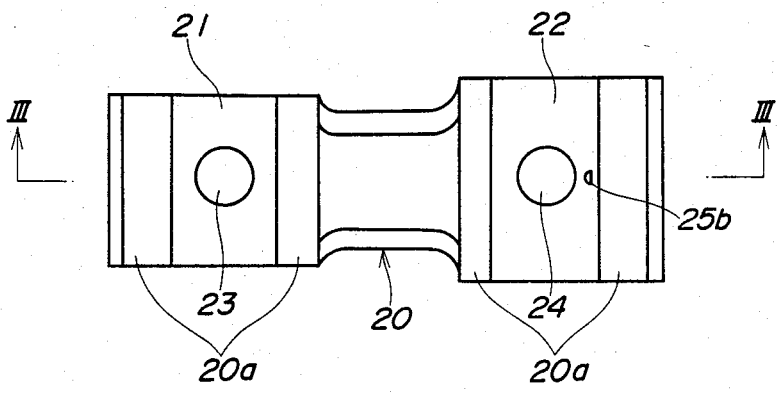
FIG. 3 taken on the line III—III in FIG. 3 is a plan view showing a camshaft holder according to an embodiment of the invention.

It is certified that error appears in the above-identified patent and that said Letters Patent is hereby corrected as shown below:

Column 3, line 4 after "Fig. 3" delete "taken on the line III-III in Fig. 3"
Column 3, line 8 insert after "Fig. 3" --taken on the line III-III in Fig. 3--
Column 3, line 9 after "Fig. 5 is a" delete "schematic".
Column 3, line 30 after "each" insert --of--.
Column 3, line 32 after "each" insert --of--.
Column 4, line 31 remove the comma after the word "provided".
Column 4, line 33 before "which" insert --respectively, and--.
Column 4, line 33 before "extend" delete the word "which".
Column 4, line 35 correct the spelling of "peripheral".
Column 4, line 63 after "end" insert --opening--.
Column 4, line ~~6xx~~ 65 after "opening" change "in" to --into--.
Column 4, line 67 after "opening" change "in" to --into--.
Column 5, line 1 after "ing" change "in" to --into--.
Column 10, line 4 after "claim" change "8" to --7--.

Signed and Sealed this

*Twenty-fourth* Day of *June 1986*

[SEAL]

*Attest:*

DONALD J. QUIGG

*Attesting Officer*

*Commissioner of Patents and Trademarks*